United States Patent [19]

Sugita

[11] Patent Number: 4,797,304

[45] Date of Patent: Jan. 10, 1989

[54] CONTINUOUS COATING METHOD CAPABLE OF ACHIEVING HIGHER YIELD

[75] Inventor: Tunezo Sugita, Odawara, Japan

[73] Assignee: Konishiroku Photo Industry Co., Ltd., Tokyo, Japan

[21] Appl. No.: 947,603

[22] Filed: Dec. 30, 1986

[30] Foreign Application Priority Data

Mar. 18, 1986 [JP] Japan ..... 61-59899

[51] Int. Cl.[4] ..... B05D 5/10; G03C 1/495

[52] U.S. Cl. ..... 427/208.6; 427/207.1; 430/271; 430/523; 430/935; 430/950; 430/961; 118/70; 118/203; 118/652; 156/344

[58] Field of Search ..... 427/207.1, 208.6; 430/523, 935, 271, 950, 961; 156/344; 118/70, 203, 652

[56] References Cited

U.S. PATENT DOCUMENTS

| | | | |
|---|---|---|---|
| 3,672,933 | 6/1972 | Liebermann | 430/935 |
| 3,837,952 | 9/1974 | Mogford | 156/344 |
| 3,849,166 | 11/1974 | Omichi et al. | 430/935 |
| 4,427,726 | 1/1984 | Wolfrum | 428/43 |

*Primary Examiner*—George F. Lesmes
*Assistant Examiner*—P. J. Ryan
*Attorney, Agent, or Firm*—Jordan B. Bierman

[57] ABSTRACT

In a coating method for applying a coating layer on at least one surface of an elongated support that travels continuously as it is transported on rollers, an adhesive layer is formed in selected areas of one surface of the support in contact with the roller, with no coating layer being formed in those areas of the support being transported which have the adhesive layer whereas a coating layer is formed in those areas of the support which have no adhesive layer.

8 Claims, 1 Drawing Sheet

CONTINUOUS COATING METHOD CAPABLE OF ACHIEVING HIGHER YIELD

BACKGROUND OF THE INVENTION

The present invention relates to a coating method and, in particular, to a coating method that is capable of effectively preventing the occurrence of troubles due to deposition of dust and dirt in a support transport line on rollers.

The conventional process for the production of photographic paper and films on a large scale consists of transporting an elongated strip of support over many rollers of various types so as to form a coating of emulsion or other components on the support and slitting the coated web into desired sizes. The length of the transport line used in this method will, of course, depend on the size of the plant in which it is housed and, in an extreme case, the transport line may extend as long as several hundred to several thousand meters and requires no less than $10^3$–$10^4$ rolls.

The production line is operated in a strictly controlled environment so that the buildup of dust and dirt is held to a minimum but it has been impossible to avoid fragments of the support itself, which may be in the form of paper or plastic particles, from being brought into the line. This problem (i.e., dust or dirt buildup due to paper or plastic particles) becomes pronounced if the line speed is increased in order to comply with the growing demand for photographic paper and films and to meet the requirements of modern plants such as a lower production cost. If dust or dirt sticks to the back side of the support during coating operations, the affected areas of the support will protrude upwardly and cause unevenness in the layer formed by continuous coating. This "streaking" phenomenon is fatal to the final product and the yield of commercially acceptable products is accordingly decreased.

Conventionally, such dirt and dust are removed by manual clean-up operations during periodic shutdowns but this method has the disadvantage that complete clean up of areas of limited access is not possible and that it is quite time-consuming. Because of these problems, manual cleanup operations have not been conducive to achieving a high production rate and a low production cost.

A particular problem arises durig the cleanup of a production line employing grained rollers having fine asperity on their surface; that is, the dirt, dust or any other foreign matter that has been trapped in cavities in the surface of a grained roller cannot be readily removed by routine cleanup procedures. Grained rollers are chiefly used in areas where a travelling elongated support is likely to be subjected to local load for the purpose of stabilizing the overall support transport line. If one wants to speed up the production line, it is essential to incorporate grained rollers in selected portions of the transport line.

The present inventors made concerted efforts to develop a coating method for applying a coating layer on at least one surface of an elongated support that travels continuously as it is transported on rollers in the production of photographic paper and films. As a result, the inventors have devised a system wherein an adhesive layer is formed in selected areas of one surface of the support in contact with the rollers; this system is operated in such a manner that no coating layer is formed in those areas of the support being transported which have the adhesive layer, whereas a coating layer is formed in those areas of the support which have no adhesive layer. The product attained by this coating method does not experience any of the trouble that would otherwise be caused by transfer of dust or dirt from the roll surface. In addition, the rollers can be readily cleaned up within a short period of time without suspending the flow of the production line.

SUMMARY OF THE INVENTION

An object, therefore, of the present invention is to provide a coating method that is capable of efficiently preventing the occurrence of troubles that result from the deposition of dust or dirt picked up from rollers.

Another object of the present invention is to provide a coating method that achieves a reduction in the production cost and an increase in the yield of the product.

These objects of the present invention can be attained by a coating method for applying a coating layer on at least one surface of an elongated support that travels continuously as it is transported on rollers, wherein an adhesive layer is formed in selected areas of one surface of the support in contact with the rollers, with no coating layer being formed in those areas of the support being transported which have the adhesive layer whereas a coating layer is formed in those areas of the support which have no adhesive layer.

DETAILED DESCRIPTION OF THE INVENTION

Figure 1:
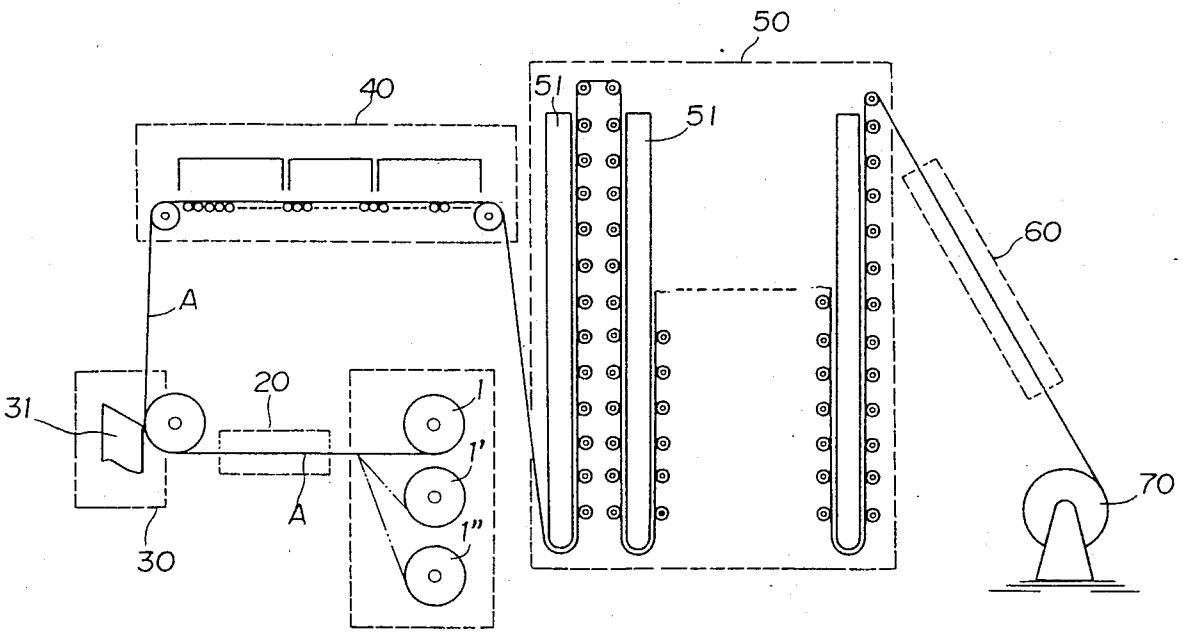
FIG. 1 is a schematic diagram of the production of photographic paper employing the coating method of the present invention.

The coating method of the present invention is intended to be applied to a system in which an elongated support is continuously transported chiefly on rollers. Rollers that can be used in the support transport line include: metal rollers formed of metals such as stainless steel; rollers the surface of which is made of rigid plastics; smooth-surfaced rollers such as elastic rollers that are formed of rubbers and other elastic materials; and grained rollers having a textured surface (i.e., surfaces with fine asperity). Grained rollers are incorporated in selected areas of the transport line in order to stabilize it so that the support will not be subjected to any excessive load even if the travelling support is extremely long or if the transport speed and, hence, the production line speed is increased.

Examples of the elongated support used in the present invention are flexible supports such as paper, synthetic paper, paper or synthetic paper laminated with a baryta layer or α-olefinic polymers, as well as semisynthetic or synthetic high-molecular weight materials such as cellulose acetate, cellulose nitrate, polystyrene, poly (vinyl chloride), polyethylene terephthalate, polycarbonate, and polyamide.

The coating method of the present invention is applicable to any of the systems in which a coating layer is formed on the elongated support that is allowed to run continuously through a transport line on rollers. The method is hereinafter described in detail with reference to the case where it is applied to the process of production of photographic paper.

FIG. 1 is a schematic diagram of the process of producing photographic paper. A creel 10 contains a plurality of bulk rolls 1,1' and 1'' from which three elongated supports are delivered and automatically spliced to form a single continuous web A. In FIG. 1, three bulk rolls are shown but more bulk rolls may of course be employed.

Support A is fed into a pretreatment zone 20, in which the surface of the support where a coating layer (i. e., emulsion layer) is to be formed is rendered hydrophilic or treated otherwise in order to enhance the adhesion between the emulsion layer and the coating surface of the support. Rollers (not shown) are also employed in the pretreatment zone 20 for transporting the support.

The support A is then fed into a coating zone 30 in which a coating machine 31 applies photographic layers in a predetermined order on the support. The photographic layers to be applied in zone 30 include silver halide emulsion layers, non-light-sensitive layers and any other layers that use hydrophilic colloids (e.g. gelatin) as binders. The coating machine 31 is movable such that when there is no need to apply coatings, it moves away from the support to avoid contact thereof with the coating fluid and, in synchronism with this movement of the machine, the supply of the coating fluid is suspended. The coating machine 31 is preferably in the form of an extrusion coater, a curtain coater or any other coaters that are capable of simultaneous coating of multiple layers.

The support A to which the photographic layers have been applied is fed into a cooling/solidification zone 40 in which the gelatin in the applied layers is allowed to gel. Zone 40 contains a number of chill rolls that serve to accelerate the cooling of the applied layers.

Support A is then transferred into a drying zone 50 in which the support is dried to a predetermined level of dryness as it is transported along a plurality of wind columns 51 having holes through which hot air is blown against the support. A large number of transport rollers are also used in the drying zone 50.

After the drying step, support A is fed into an inspection zone 60 for locating any substandard products which need to be rejected from the production line. Finally, the acceptable product alone is taken up by a winder 70.

In the zone in which a coating layer is formed on at least one surface of the continuously travelling support A, the force for driving the support is chiefly provided by the winder 70, and in selected areas of this zone are located auxiliary drive rollers that assist in the transport of the support A by detecting the torque being exerted on it, as well as grained rollers that serve as free rollers. In FIG. 1, neither the auxiliary drive rollers nor grained rollers are shown in such a manner as to be distinguishable, from the other types of rollers.

In accordance with the present invention, an adhesive layer is preliminarily formed on selected areas of support A. For instance, bulk roll 1' shown in FIG. 1 is reserved for delivering a support having an adhesive layer, whereas bulk rolls 1 and 1'' are reserved for delivering supports having no adhesive layer. The three webs of support are then spliced to form a single continuous web, and no coating layer is formed when the portion of the support having the adhesive layer as delivered from roll 1' is being transported whereas a coating layer is formed when the portions of support having no adhesive layer as supplied from rolls 1 and 1'' are being transported. When the support supplied from roll 1' is flowing through the coating zone, any dirt or dust that is present on the surface of transport rollers in contact with the surface of the support having the adhesive layer transfers onto the adhesive layer so as to provide a clean transport line that permits the ensuing support from roll 1'' to be coated with the necessary photographic layers without experiencing any of the trouble that would be caused if dirt or dust were to be picked up from the surface of the rollers.

The length of the support having the adhesive layer is appropriately determined by such factors as the general condition of the production line and the type of adhesive agent used in the adhesive layer.

Examples of the adhesive agents that may be used in the adhesive layer include natural rubber, synthetic rubbers such as styrene/butadiene rubber, polyisobutylene and polychloroprene, acrylic adhesives such as butyl acrylate and ethyl acrylate, urethane-based adhesives, vinyl-based adhesives such as polyvinyl butyral and vinyl chloride/vinyl acetate copolymers, and mixtures thereof. More specific examples of usable adhesives are show in Japanese Patent Application (OPI) Nos. 10578/1981, 205412/1982, 137375/1982, 40580/1982, 32679/1983, 213072/1983, 215474/1983, 217576/1983, 149970/1984, 174680/1984, 89381/1984, 91178/1984, 91179/1984, 96181/1984, 98184/1984 and 129283/1984 (the term OPI as used above and hereinafter means an unexamined published Japanese patent application). Choice of an appropriate adhesive agent depends on various factors such as the general condition of the support transport line.

If resin-coated paper is used as a support, the surface of the paper on which an adhesive layer is to be formed is preferably rendered hydrophilic in advance by such treatments as subbing, flame treatment, corona charging or the like, because the adhesive layer applied to such hydrophilic surface will not be picked up by transport rollers and re-deposited on the support at a later stage.

The adhesive layer may be formed on both surfaces of the support A but in order to avoid any undesirable effects such as excessive load being exerted in the support transport line, the adhesive layer is preferably formed on one surface of the support. In this case, it is preferable that one portion of the support is provided with the adhesive layer on one surface while another portion of the support that is separate from said one portion is provided with the adhesive layer on the back surface. A sheet of release paper may be provided on the adhesive layer on the support that is to be delivered from bulk roll 1' and the paper is stripped from the adhesive layer before the support is spliced to the supports being delivered from rolls 1 and 1''. Alternatively, a release agent may be applied to the back surface of the support which is opposite the side where the adhesive layer is formed.

One advantage of the coating method of the present invention is associated with the line speed for the transport of an elongated support on rollers. Conventional plants for the manufacture of photographic paper and films have employed line speeds on the order of 30–50 m/min. At such slow speeds, the use of a comparatively small number of grained rollers suffices and the occurrence of dust such as paper particles introduced from the support is not substantial in such cases. However, recent advances in coating technology have been remarkable and the introduction of high-speed coating machines has enabled the overall line speed to be increased to 80–250 m/min. As the line speed is increased, the amount of dust particles such as paper dust from the support is also increased, bringing with it the need to provide improvements in the support transport line. Furthermore, the requirement for stable transport of the support has expanded the use of auxiliary drive rollers and free rollers (i.e., grained rollers) but, then, the need to remove dust from small cavities in the surface of grained rollers has become a serious problem.

The coating method of the present invention has the advantage that it achieves the intended effect irrespective of the speed at which coating is performed.

The foregoing description centers on the application of the method of the present invention to the area where a support is coated with emulsion layers and other necessary photographic layers to produce photographic paper and films. It should however be noted that this method is applicable to all cases where a coating layer is formed on an elongated support, for instance, whose raw paper is coated with a resin layer to form a resin-coated paper.

As described in the foregoing pages, in accordance with the present invention, an elongated support that is allowed to travel continuously through a transport line on rollers, especially through a line employing grained rollers, can be provided with desired coating layers without suspending the flow of the transport line to prevent or minimize the occurrence of various troubles in the coating, such as "streaks" due to the paper particles or other foreign materials that build up on the roller surface and "pepper" in the final photographic product that is caused by the re-deposition of such dust particles entering the coating layer being formed. The present invention obviates the need to clean up the transport rollers during a shutdown period, with all or some of the rollers being detached from the production line. As a result, the present invention achieves rapid cleanup operations and realizes a lower production cost and a higher product yield at the same time.

The following examples are provided for the purpose of further illustrating the present invention but are in no way to be taken as limiting.

EXAMPLE 1

A sample of photographic paper was prepared by coating a sheet of resin-coated paper (support) with emulsion layers and other photographic layers for 10 consecutive hours at a transport speed of 180 m/min in accordance with the production scheme shown in FIG. 1. The resin-coated paper had been provided with an adhesive layer at spacings of 30 m for each 1000 m. The acrylic adhesive agent shown in Japanese Patent Application (OPI) No. 149970/1984 was used in the adhesive layer. A tenth of the rollers in the transport line were grained rollers.

The incidence of troubles due to "streaks" that developed in the photographic paper was checked by determining the light transmission through the applied emulsion and other layers. The results are shown in Table 1 below, wherein the incidence of troubles is indicated in terms of the average number of troubles detected per 100 m.

A comparative sample of photographic paper was prepared as above except that no adhesive layer was formed on the support. The results of the evaluation of the quality of the photographic paper obtained are shown in Table 1.

TABLE 1

| Run No. | Adhesive layer | No. of troubles detected per 100 m 0–5 hrs | 5–10 hrs |
|---|---|---|---|
| 1 (present invention) | present | 0 | 0 |
| 2 (comparative) | absent | 65 | 830 |

In Run No. 2 wherein no provision was made to remove dust particles from the surface of any of the rollers during the continuous coating operation for 10 hours, troubles due to streaks occurred and this was particularly noticeable in the second half of the continuous coating operation. In Run No. 1 in which coating was achieved by the method of the present invention, not a single trouble occurred owing to the development of streaks and a satisfactory product was attained even when the coating operation continued for 10 hours.

EXAMPLE 2

An additional sample of photographic paper was prepared as in Example 1 except that the support was transported at a speed of 30 m/min through a transport line that was solely composed of smooth-surfaced rollers. The quality of the photographic paper thus obtained was evaluated as in Example 1 and the results are shown in Table 2. Although not a single trouble associated with "streaks" occurred, blocking troubles were detected in this experiment (Run No. 3) as a result of re-deposition of the adhesive agent on the photographic paper.

A comparative sample was prepared as above except that no adhesive layer was formed on the support (Run No. 4). In another experiment (Run No. 5), the surface of the support which was to be provided with an adhesive layer at given spacings was rendered hydrophilic by a suitable treatment such as subbing, flame treatment or corona charging. The results of the evaluation of the quality of the photographic papers prepared in Run Nos. 4 and 5 are also shown in Table 2.

TABLE 2

| Run No. | Adhesive layer | No. of troubles detected per 100 m 0–5 hrs | 5–10 hrs |
|---|---|---|---|
| 3 (present invention) | present | 5 (blocking troubles) | 7 (blocking troubles) |
| 4 (comparative) | absent | 10 (streak-associated troubles) | 75 (streak-associated troubles) |
| 5 (present invention) | present | 0 | 0 |

In Run No. 4 (comparative experiment), troubles due to streaks occurred although their incidence was lower than in Run No. 2 which was also a comparative experiment (Example 1). In Run No. 3 that was conducted in accordance with the present invention, the occurrence of such troubles could be prevented but a new type of trouble occurred on account of the redeposition of the adhesive agent on the photographic paper. Both types of troubles could be effectively prevented in Run No. 5 wherein the surface of the support was rendered hydrophilic before application of the adhesive layer.

The overall results of Examples 1 and 2 show the following: the coating method of the present invention provides satisfactory results in coating operations that are achieved with smoothsurfaced rolls at a transport speed of 30 m/min; even if the transport speed is increased by employing grained rollers, the method of the present invention ensures satisfactory results without causing either streak-associated troubles (this has been frequent in the use of grained rollers) or re-deposition of the adhesive layer.

What is claimed is:

1. A method of applying a coating layer on at least one surface of an elongated support traveling continuously on rollers comprising providing said coating layer on said support, providing an adhesive layer on selected areas of at least one surface of said support in contact with at least some of said rollers, wherein some portions of said coating layer have no adhesive layer thereon and whereby substantially no adhesive from said adhesive layer is transferred onto a surface of any of said rollers.

2. The method of claim 1 wherein at least one of said selected areas is adjacent to at least one of said portions.

3. The method of claim 1 comprising rendering said selected areas hydrophilic before forming said adhesive layer.

4. The method of claim 1 wherein said selected areas are spliced to said elongated support.

5. The method of claim 1 wherein said selected areas are located at the front end of said elongated support.

6. The method of claim 1 wherein said selected area are located at the rear end of said elongated support.

7. The method of claim 3 wherein said elongated support is a resin-coated paper.

8. A method of applying a coating layer on at least one surface of an elongated support traveling continuously on rollers comprising forming an adhesive layer on selected areas of at least one surface of said support in contact with at least some of said rollers, forming said coating layer on other areas of said support having no adhesive layer, and not forming said coating layer on said selected areas whereby substantially no adhesive from said adhesive layer is transferred onto a surface of any of said rollers.

* * * * *